US011469512B2

(12) United States Patent
Lai et al.

(10) Patent No.: US 11,469,512 B2
(45) Date of Patent: Oct. 11, 2022

(54) ANTENNA STRUCTURE

(71) Applicant: Wistron NeWeb Corp., Hsinchu (TW)

(72) Inventors: Kuo-Jen Lai, Hsinchu (TW); Kuang-Yuan Ku, Hsinchu (TW); Chiung-Hung Li, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 15 days.

(21) Appl. No.: 17/349,208

(22) Filed: Jun. 16, 2021

(65) Prior Publication Data

US 2022/0069473 A1 Mar. 3, 2022

(51) Int. Cl.

| | |
|---|---|
| ***H01Q 13/10*** | (2006.01) |
| ***H01Q 5/357*** | (2015.01) |
| ***H01Q 1/48*** | (2006.01) |
| *H01Q 1/24* | (2006.01) |

(52) U.S. Cl.

CPC ..... *H01Q 13/106* (2013.01); *H01Q 1/48* (2013.01); *H01Q 5/357* (2015.01); *H01Q 1/243* (2013.01)

(58) Field of Classification Search

CPC ..... H01Q 13/10; H01Q 5/35; H01Q 1/48; H01Q 1/24

See application file for complete search history.

(56) References Cited

U.S. PATENT DOCUMENTS

| | | | | |
|---|---|---|---|---|
| 10,056,696 | B2 * | 8/2018 | Tseng | H01Q 1/48 |
| 10,910,698 | B2 * | 2/2021 | Wei | H01Q 5/357 |

FOREIGN PATENT DOCUMENTS

| | | |
|---|---|---|
| TW | I557987 B | 11/2016 |
| TW | M537316 U | 2/2017 |
| TW | I697151 B | 6/2020 |

* cited by examiner

*Primary Examiner* — Andrea Lindgren Baltzell
(74) *Attorney, Agent, or Firm* — McClure, Qualey & Rodack, LLP

(57) ABSTRACT

An antenna structure includes a metal mechanism element, a dielectric substrate, a feeding radiation element, and a coupling radiation element. The metal mechanism element has a slot. The slot has a first closed end and a second closed end. The dielectric substrate has a first surface and a second surface which are opposite to each other. The feeding radiation element is coupled to a signal source, and is disposed on the second surface of the dielectric substrate. The feeding radiation element has a first vertical projection on the metal mechanism element. The coupling radiation element is coupled to a ground voltage, and is disposed on the first surface of the dielectric substrate. The coupling radiation element has a second vertical projection on the metal mechanism element. The second vertical projection of the coupling radiation element at least partially overlaps the first vertical projection of the feeding radiation element.

20 Claims, 12 Drawing Sheets

ANTENNA STRUCTURE

CROSS REFERENCE TO RELATED APPLICATIONS

This application claims priority of Taiwan Patent Application No. 109129823 filed on Sep. 1, 2020, the entirety of which is incorporated by reference herein.

BACKGROUND OF THE INVENTION

Field of the Invention

The disclosure generally relates to an antenna structure, and more particularly, it relates to a multiband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, the communication quality of the mobile device will suffer. Accordingly, it has become a critical challenge for antenna designers to design a small wideband antenna element.

BRIEF SUMMARY OF THE INVENTION

In an exemplary embodiment, the disclosure is directed to an antenna structure that includes a metal mechanism element, a dielectric substrate, a feeding radiation element, and a coupling radiation element. The metal mechanism element has a slot. The slot has a first closed end and a second closed end. The dielectric substrate has a first surface and a second surface which are opposite to each other. The feeding radiation element is coupled to a signal source, and is disposed on the second surface of the dielectric substrate. The feeding radiation element has a first vertical projection on the metal mechanism element. The coupling radiation element is coupled to a ground voltage, and is disposed on the first surface of the dielectric substrate. The coupling radiation element has a second vertical projection on the metal mechanism element. The second vertical projection of the coupling radiation element at least partially overlaps the first vertical projection of the feeding radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
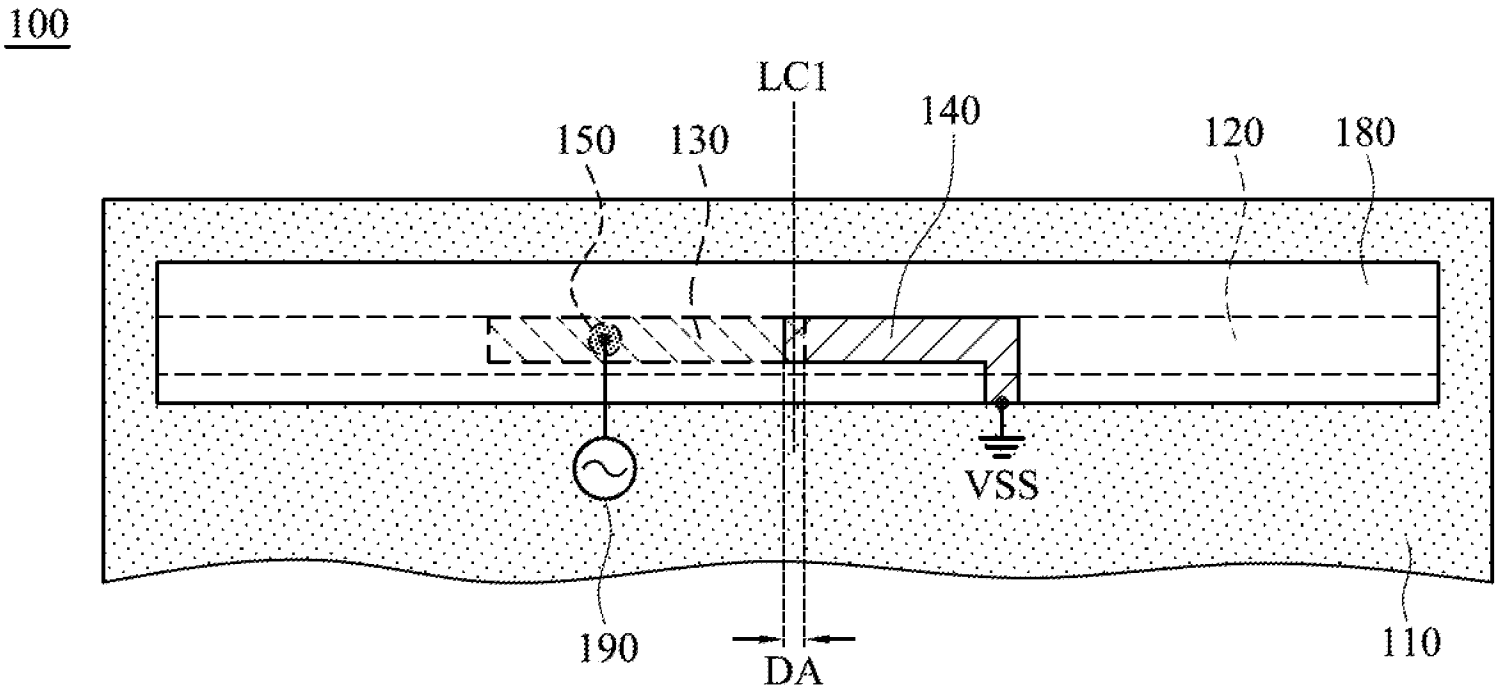
FIG. 1A is a perspective view of an antenna structure according to an embodiment of the invention.

FIG. 1A is a perspective view of an antenna structure 100 according to an embodiment of the invention. The antenna structure 100 may be applied to a mobile device, such as a smartphone, a tablet computer, or a notebook computer. As shown in FIG. 1A, the antenna structure 100 at least includes a metal mechanism element 110, a feeding radiation element 130, a coupling radiation element 140, and a dielectric substrate 180. The feeding radiation element 130 and the coupling radiation element 140 may both be made of metal materials, such as copper, silver, aluminum, iron, or their alloys.

The metal mechanism element 110 may be a metal housing of a mobile device. In some embodiments, the metal mechanism element 110 is a metal upper cover of a notebook computer, or a metal back cover of a tablet computer, but it is not limited thereto. For example, if the mobile device is a notebook computer, the metal mechanism element 110 may be the so-called "A-component" in the field of notebook computers. The metal mechanism element 110 has a slot 120. The slot 120 of the metal mechanism element 110 may substantially have a straight-line shape. Specifically, the slot 120 has a first closed end 121 and a second closed end 122 which are away from each other. The antenna structure 100 may also include a nonconductive material which fills the slot 120 of the metal mechanism element 110, so as to achieve the waterproof or dustproof function.

Figure 1B:
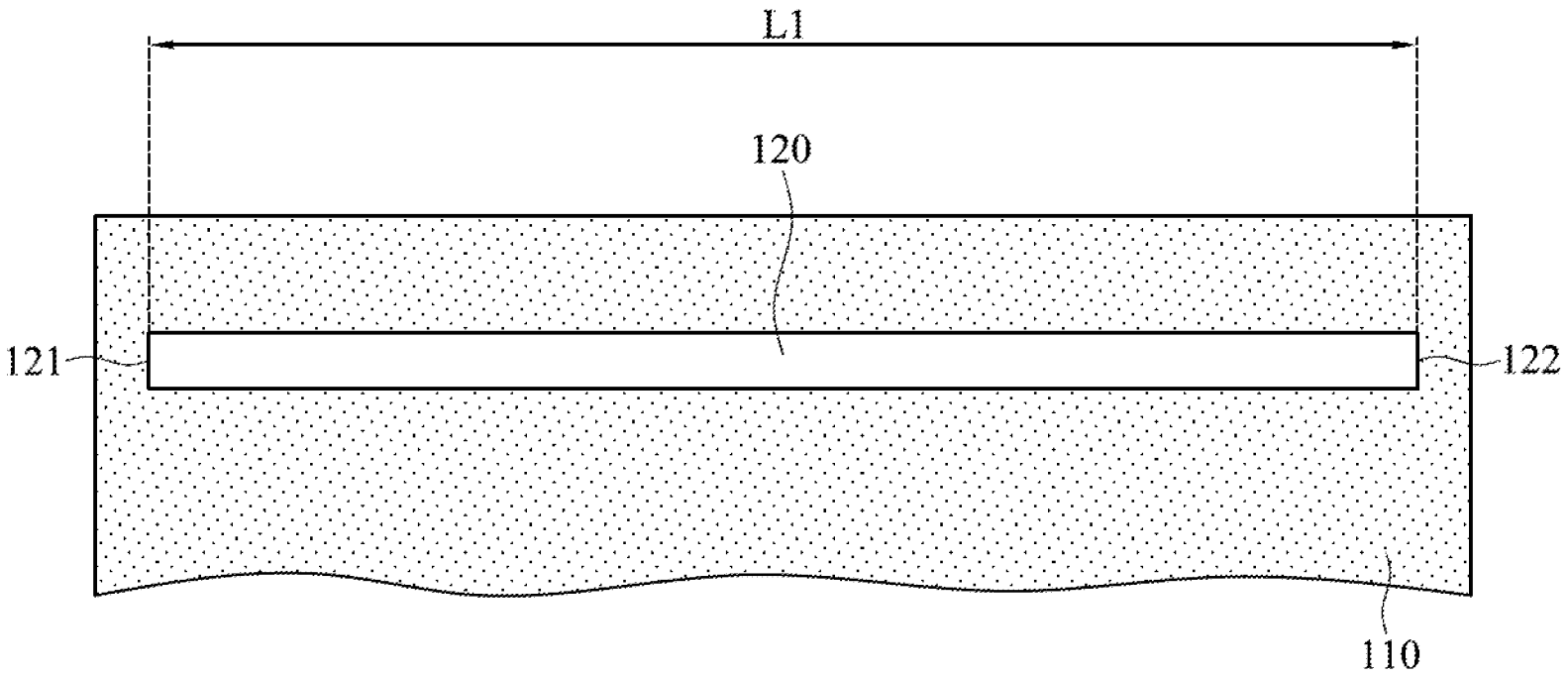
FIG. 1B is a top view of a metal mechanism element of an antenna structure according to an embodiment of the invention.
Figure 1C:
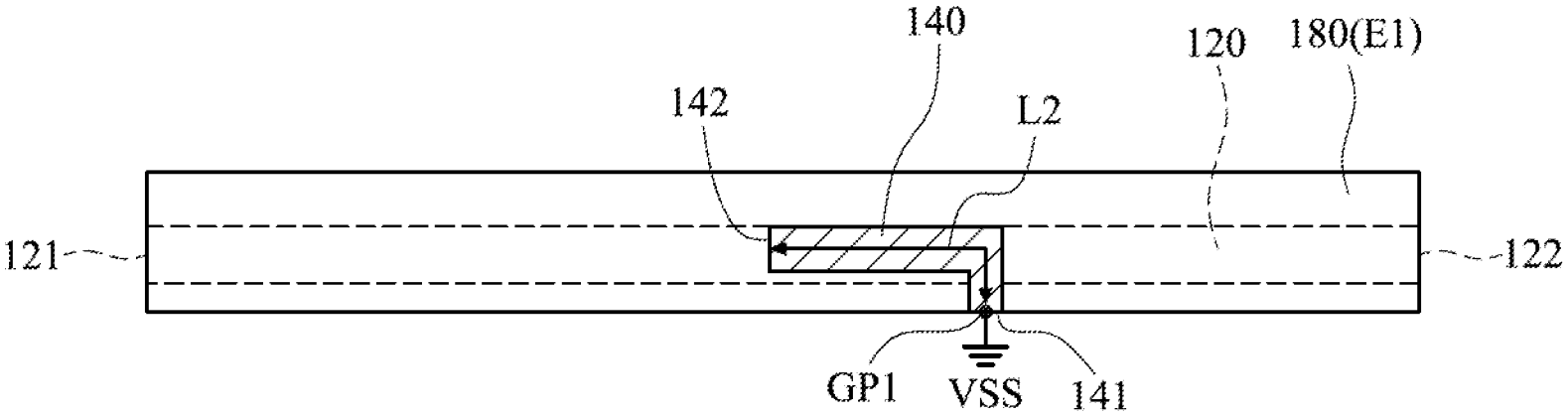
FIG. 1C is a top view of partial elements of an antenna structure on a first surface of a dielectric substrate according to an embodiment of the invention.
Figure 1D:
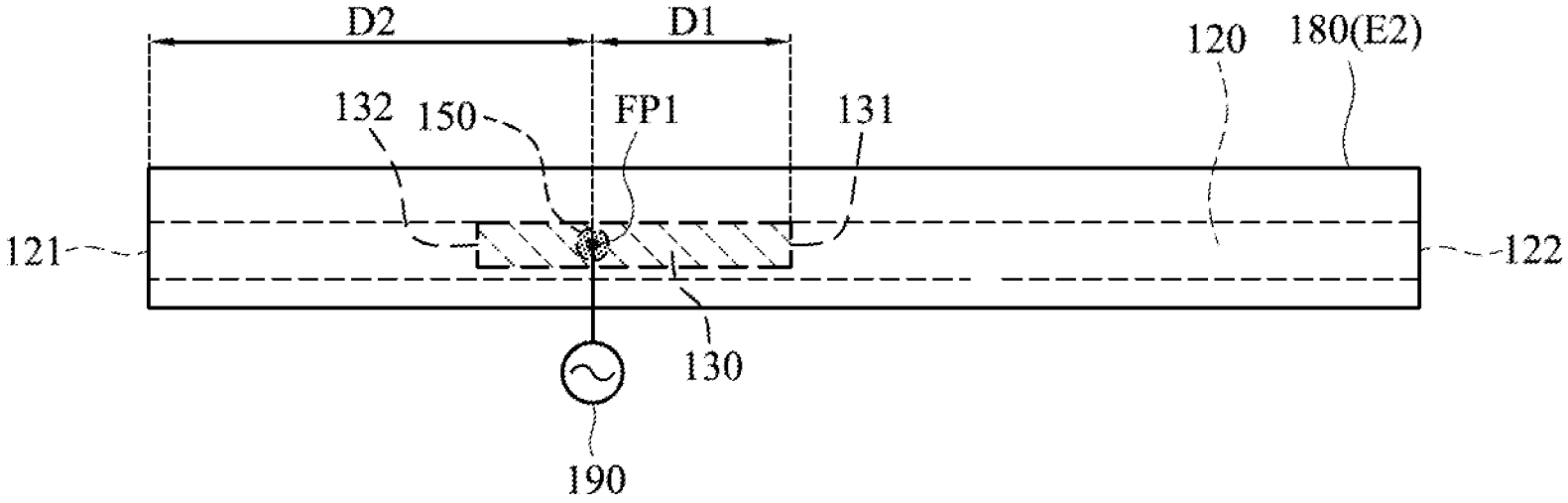
FIG. 1D is a see-through view of other partial elements of an antenna structure on a second surface of a dielectric substrate according to an embodiment of the invention.
Figure 1E:
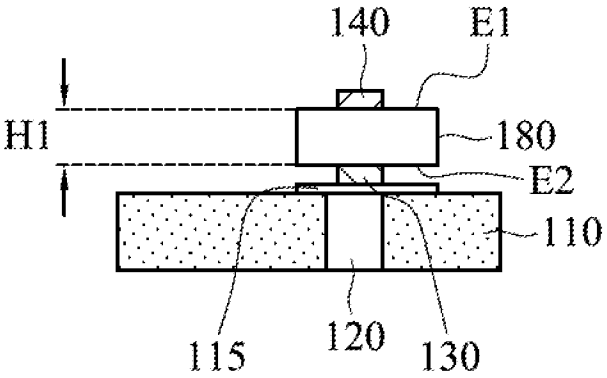
FIG. 1E is a sectional view of an antenna structure according to an embodiment of the invention.

The dielectric substrate 180 may be an FR4 (Flame Retardant 4) substrate, a PCB (Printed Circuit Board), or an FPC (Flexible Printed Circuit). The dielectric substrate 180 has a substrate vertical projection on the metal mechanism element 110, and the substrate vertical projection can cover the whole slot 120 of the metal mechanism element 110. The dielectric substrate 180 has a first surface E1 and a second surface E2 which are opposite to each other. The second surface E2 of the dielectric substrate 180 is adjacent to the slot 120 of the metal mechanism element 110. It should be noted that the term "adjacent" or "close" over the disclosure means that the distance (spacing) between two corresponding elements is smaller than a predetermined distance (e.g., 5 mm or shorter), but often does not mean that the two corresponding elements directly touch each other (i.e., the aforementioned distance/spacing therebetween is reduced to 0). The coupling radiation element 140 may be disposed on the first surface E1 of the dielectric substrate 180, and the feeding radiation element 130 may be disposed on the second surface E2 of the dielectric substrate 180. Alternatively, the coupling radiation element 140 may be disposed on the second surface E2 of the dielectric substrate 180, and the feeding radiation element 130 may be disposed on the first surface E1 of the dielectric substrate 180. The two designs do not affect the performance of the invention. In some embodiments, the antenna structure 100 further includes a support element 115, which may be made of a nonconductive material, such as a plastic material. The support element 115 is disposed on the metal mechanism element 110, and is configured to support and fix the dielectric substrate 180 and all of the elements thereon. The support element 115 can prevent the feeding radiation element 130 from directly touching the metal mechanism element 110. It should be understood that the support element 115 is an optional element, which is omitted from other embodiments. FIG. 1B is a top view of the metal mechanism element 110 of the antenna structure 100 according to an embodiment of the invention. FIG. 1C is a top view of partial elements of the antenna structure 100 on the first surface E1 of the dielectric substrate 180 according to an embodiment of the invention. FIG. 1D is a see-through view of other partial elements of the antenna structure 100 on the second surface E2 of the dielectric substrate 180 according to an embodiment of the invention (i.e., the dielectric substrate 180 is considered as a transparent element). FIG. 1E is a sectional view of the antenna structure 100 according to an embodiment of the invention (along a sectional line LC1). Please refer to FIG. 1A, FIG. 1B, FIG. 1C, FIG. 1D and FIG. 1E together to understood the invention.

The feeding radiation element 130 may substantially have a straight-line shape. A feeding point FP1 of the feeding radiation element 130 may be coupled to a signal source 190. For example, the signal source 190 may be an RF (Radio Frequency) module for exciting the antenna structure 100. Specifically, the feeding radiation element 130 has a first end 131 and a second end 132, which are two open ends away from each other. The first end 131 of the feeding radiation element 130 is adjacent to the coupling radiation element 140. In addition, the feeding point FP1 may be positioned between the first end 131 and the second end 132 of the feeding radiation element 130, and is relatively closer to the second end 132 of the feeding radiation element 130. The feeding radiation element 130 has a first vertical projection on the metal mechanism element 110, and the first vertical projection may be completely inside the slot 120 of the metal mechanism element 110.

In some embodiments, the antenna structure 100 further includes a conductive via element 150, which may penetrate the dielectric substrate 180 and may be connected between the first surface E1 and the second surface E2. The feeding point FP1 of the feeding radiation element 130 may be further coupled through the conductive via element 150 to the signal source 190. However, the invention is not limited thereto. In alternative embodiments, the conductive via element 150 is omitted, such that the feeding point FP1 of the feeding radiation element 130 is directly coupled to the signal source 190. In some embodiments, the signal source 190 uses a coaxial cable (not shown) for exciting the feeding radiation element 130.

The coupling radiation element 140 may substantially have an equal-width L-shape. Specifically, the coupling radiation element 140 has a first end 141 and a second end 142. A grounding point GP1 coupled to the ground voltage VSS is positioned at the first end 141 of the coupling radiation element 140. The second end 142 of the coupling radiation element 140 is an open end. For example, the ground voltage VSS may be provided by a ground copper foil (not shown), which may be further coupled to the metal mechanism element 110. The coupling radiation element 140 has a second vertical projection on the metal mechanism element 110, and the second vertical projection is at least partially inside the slot 120 of the metal mechanism element 110. In addition, the second vertical projection of the coupling radiation element 140 at least partially overlaps the first vertical projection of the feeding radiation element 130. Thus, a coupling gap can be formed between the second end 142 of the coupling radiation element 140 and the first end 131 of the feeding radiation element 130.

Figure 2:
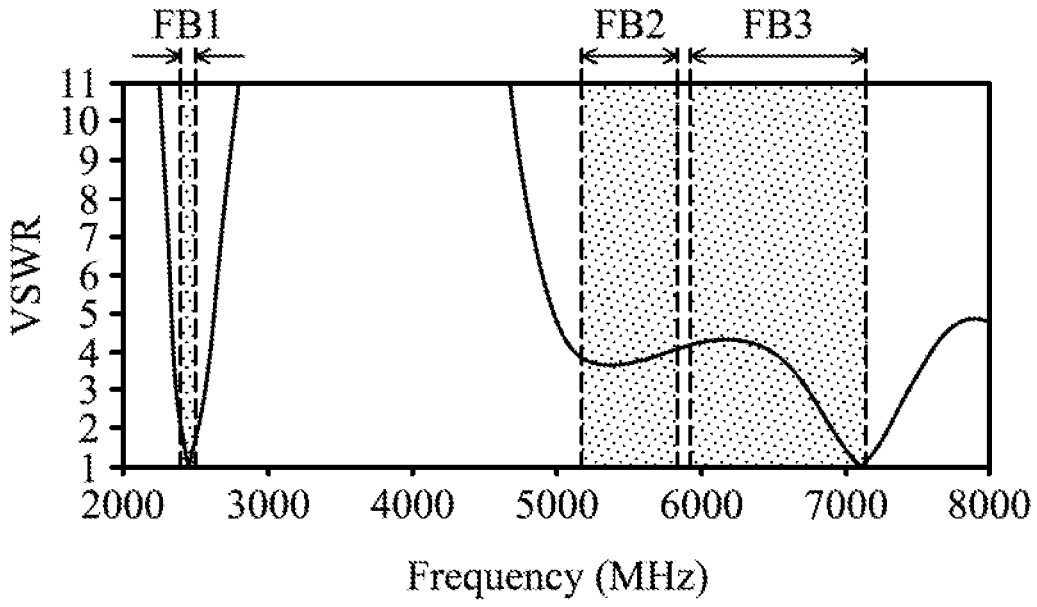
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents operation frequency (MHz), and the vertical axis represents the VSWR. According to the measurement of FIG. 2, the antenna structure 100 covers a first frequency band FB1, a second frequency band FB2, and a third frequency band FB3. For example, the first frequency band FB1 may be from 2400 MHz to 2495 MHz, the second frequency band FB2 may be from 5150 MHz to 5835 MHz, and the third frequency band FB3 may be from 5925 MHz to 7125 MHz. Thus, the antenna structure 100 can support at least the wideband operations of the next generation Wi-Fi 6E.

With respect to the antenna theory, an equivalent capacitor can be formed between the first end 131 of the feeding radiation element 130 and the second end 142 of the coupling radiation element 140, such that the feeding radiation element 130 and the coupling radiation element 140 are almost considered as a loop structure. In addition, the slot 120 of the metal mechanism element 110 can be excited by the aforementioned loop structure using a coupling mechanism, so as to completely cover the wideband operations of the first frequency band FB1, the second frequency band FB2, and the third frequency band FB3.

Figure 3:
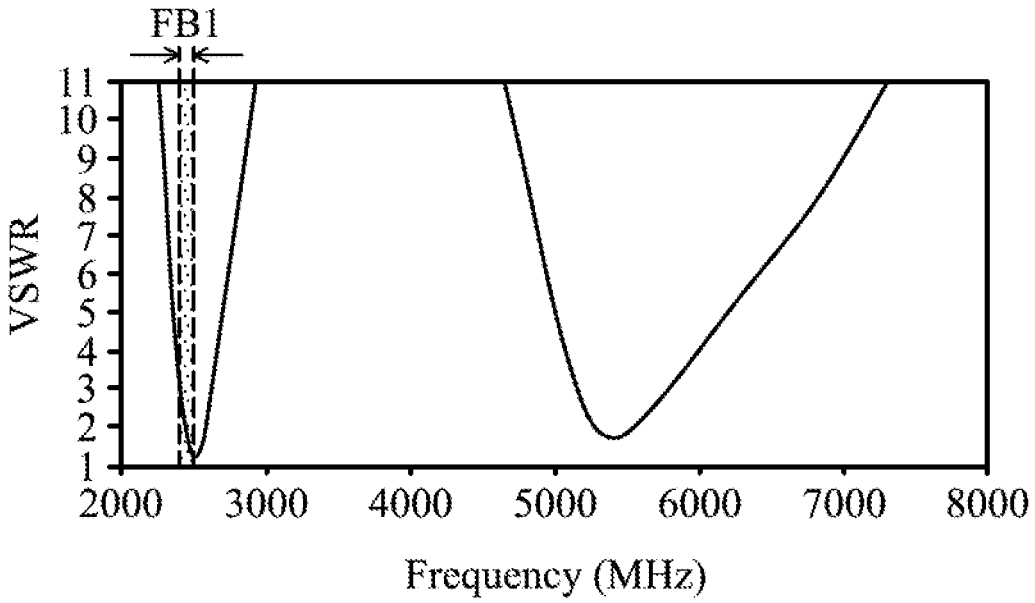
FIG. 3 is a diagram of VSWR of an antenna structure if the grounding point is removed from the coupling radiation element.

FIG. 3 is a diagram of VSWR of the antenna structure 100 if the grounding point GP1 is removed from the coupling radiation element 140. By comparing FIG. 2 with FIG. 3, it is understood that the ungrounded coupling radiation element 140 cannot make the antenna structure 100 cover the second frequency band FB2 and the third frequency band FB3. Thus, the proposed coupling radiation element 140 with the grounding point GP1 can significantly increase the operation bandwidth of the antenna structure 100.

In some embodiments, the sizes of the elements of the antenna structure 100 are as follows. The length L1 of the slot 120 of the metal mechanism element 110 (i.e., the length L1 from the first closed end 121 to the second closed end 122) may be from ¼ to ½ wavelength (λ/4~λ/2) of the first frequency band FB1 of the antenna structure 100. The distance D1 between the feeding point FP1 and the first end 131 of the feeding radiation element 130 may be from ⅛ to ¼ wavelength (λ/8~λ/4) of the second frequency band FB2 of the antenna structure 100. The distance D2 between the feeding point FP1 and the first closed end 121 of the slot 120 may be from ⅓ to ½ times the length L1 of the slot 120. The length L2 of the coupling radiation element 140 (i.e., the length L2 from the first end 141 to the second end 142) may be shorter than or equal to ½ wavelength (λ/2) of the third frequency band FB3 of the antenna structure 100. The thickness H1 of the dielectric substrate 180 (i.e., the distance between the first surface E1 and the second surface E2) may be from 0.2 mm to 1.6 mm. The overlapping distance DA between the first end 131 of the feeding radiation element 130 and the second end 142 of the coupling radiation element 140 may be longer than or equal to 1 mm. The above ranges of element sizes are calculated and obtained according to many experiment results, and they help to optimize the operation bandwidth and impedance matching of the antenna structure 100.

Figure 4A:
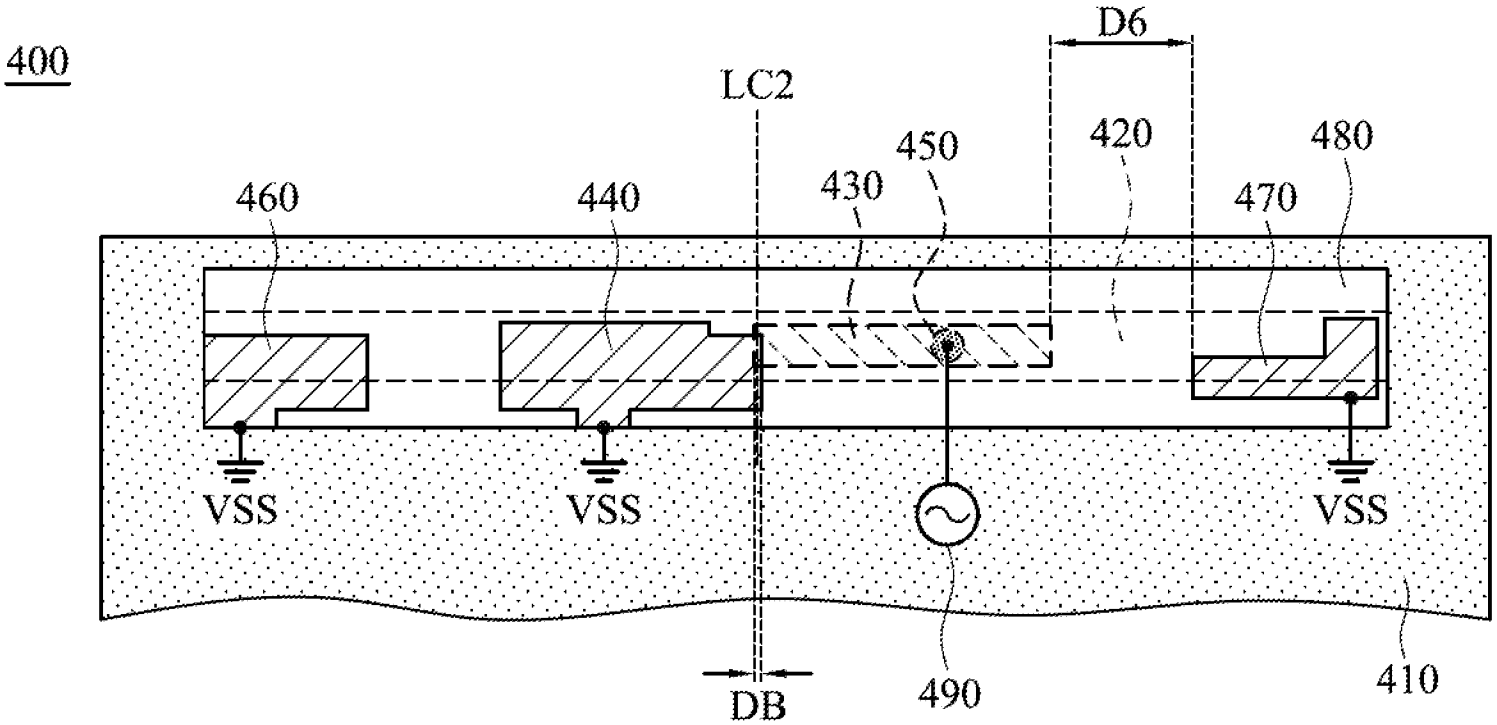
FIG. 4A is a perspective view of an antenna structure according to an embodiment of the invention.

FIG. 4A is a perspective view of an antenna structure 400 according to an embodiment of the invention. In the embodiment of FIG. 4A, the antenna structure 400 includes a metal mechanism element 410, a feeding radiation element 430, a coupling radiation element 440, a conductive via element 450, a first parasitic radiation element 460, a second parasitic radiation element 470, and a dielectric substrate 480. The feeding radiation element 430, the coupling radiation element 440, the first parasitic radiation element 460, and the second parasitic radiation element 470 may all be made of metal materials.

The metal mechanism element 410 has a slot 420. The slot 420 of the metal mechanism element 410 may substantially have a straight-line shape. Specifically, the slot 420 has a first closed end 421 and a second closed end 422 which are away from each other. The antenna structure 400 may also include a nonconductive material which fills the slot 420 of the metal mechanism element 410, so as to achieve the waterproof or dustproof function.

Figure 4B:
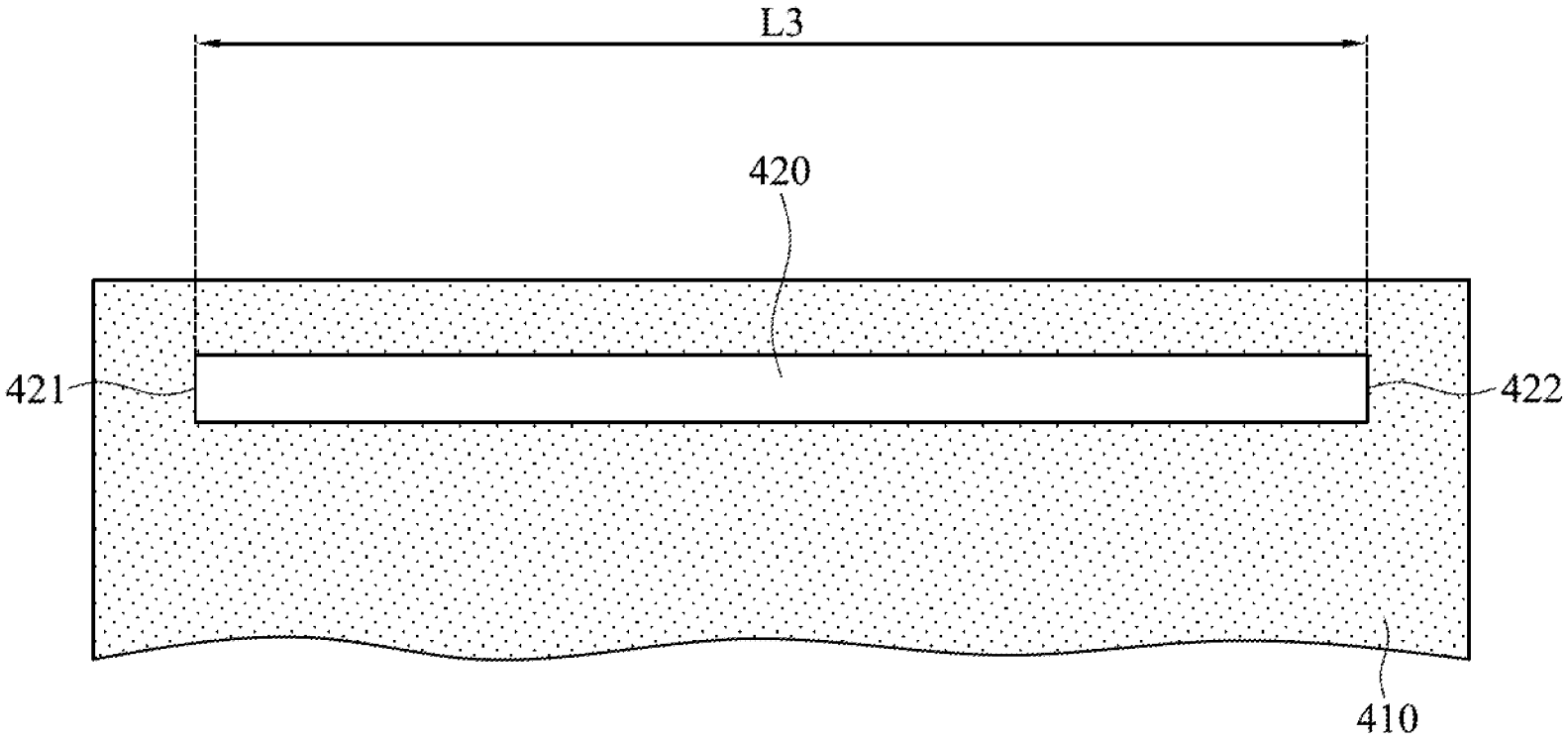
FIG. 4B is a top view of a metal mechanism element of an antenna structure according to an embodiment of the invention.
Figure 4C:
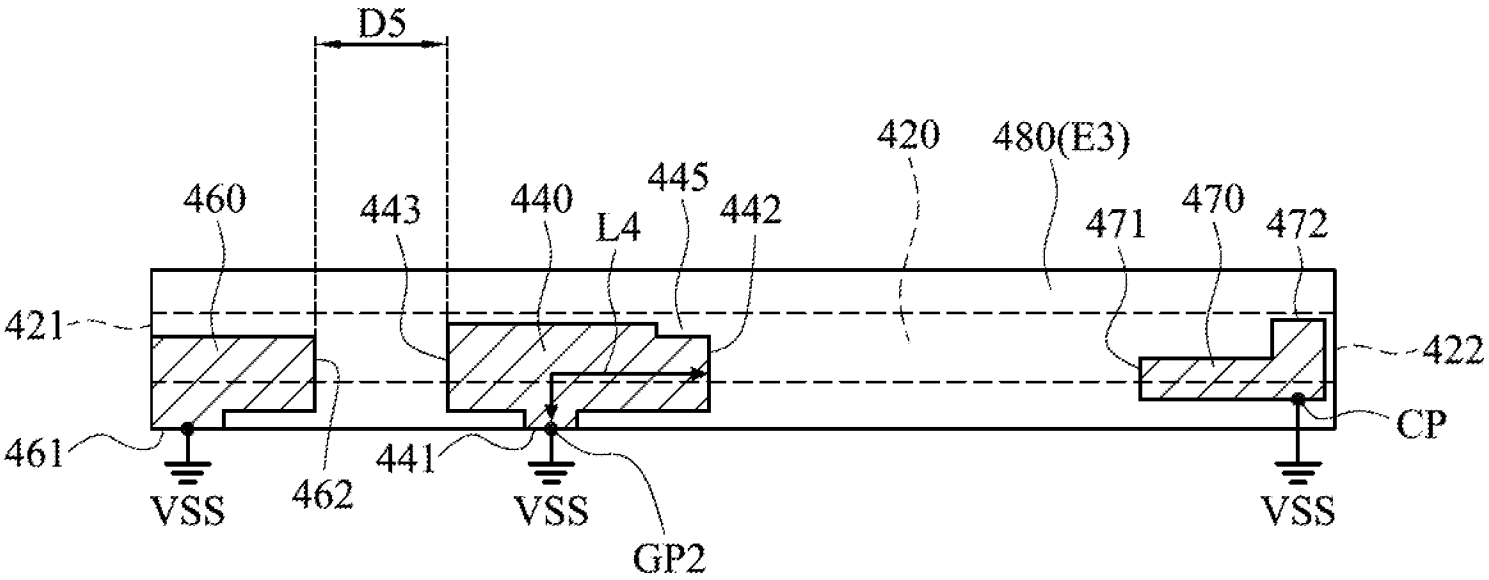
FIG. 4C is a top view of partial elements of an antenna structure on the first surface of the dielectric substrate according to an embodiment of the invention.
Figure 4D:
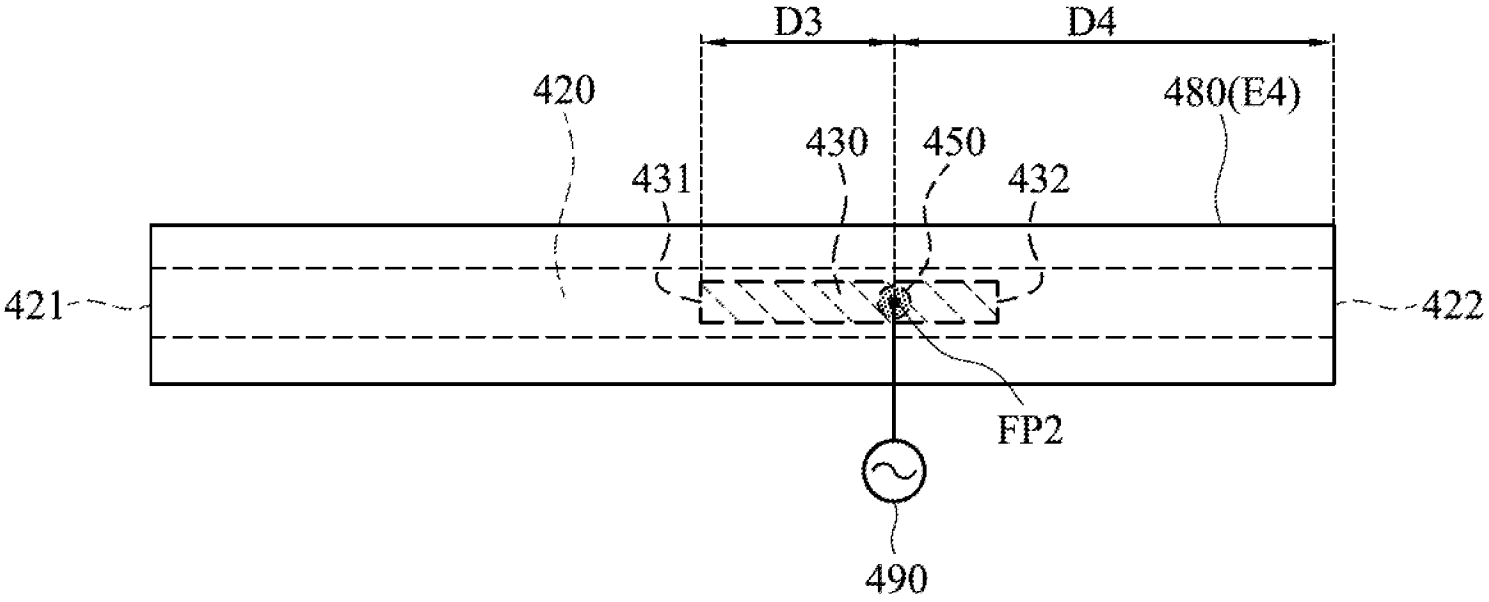
FIG. 4D is a see-through view of other partial elements of an antenna structure on a second surface of a dielectric substrate according to an embodiment of the invention.
Figure 4E:
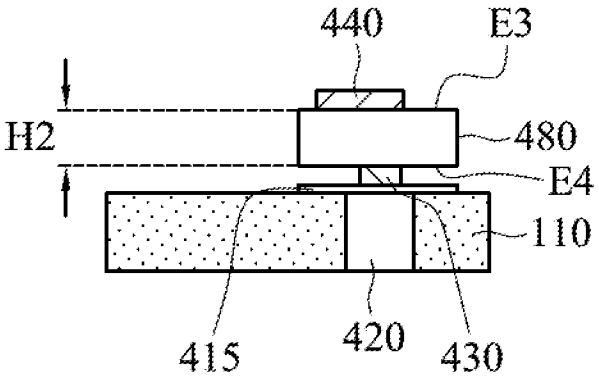
FIG. 4E is a sectional view of an antenna structure according to an embodiment of the invention.

The dielectric substrate 480 may be an FR4 substrate, a PCB, or an FPC. The dielectric substrate 480 has a first surface E3 and a second surface E4 which are opposite to each other. The second surface E4 of the dielectric substrate 480 is adjacent to the slot 420 of the metal mechanism element 410. The coupling radiation element 440, the first parasitic radiation element 460, and the second parasitic radiation element 470 may all be disposed on the first surface E3 of the dielectric substrate 480, and the feeding radiation element 430 may be disposed on the second surface E4 of the dielectric substrate 480. Alternatively, the coupling radiation element 440, the first parasitic radiation element 460, and the second parasitic radiation element 470 may be disposed on the second surface E4 of the dielectric substrate 480, and the feeding radiation element 430 may be disposed on the first surface E3 of the dielectric substrate 480. In some embodiments, the antenna structure 400 further includes a support element 415, which may be made of a nonconductive material. The support element 415 is disposed on the metal mechanism element 410, and is configured to support and fix the dielectric substrate 480 and all of the elements thereon. FIG. 4B is a top view of the metal mechanism element 410 of the antenna structure 400 according to an embodiment of the invention. FIG. 4C is a top view of partial elements of the antenna structure 400 on the first surface E3 of the dielectric substrate 480 according to an embodiment of the invention. FIG. 4D is a see-through view of other partial elements of the antenna structure 400 on the second surface E4 of the dielectric substrate 480 according to an embodiment of the invention (i.e., the dielectric substrate 480 is considered as a transparent element). FIG. 4E is a sectional view of the antenna structure 400 according to an embodiment of the invention (along a sectional line LC2). Please refer to FIG. 4A, FIG. 4B, FIG. 4C, FIG. 4D and FIG. 4E together to understood the invention.

The feeding radiation element 430 may substantially have a straight-line shape. A feeding point FP2 of the feeding radiation element 430 may be coupled to a signal source 490. For example, the signal source 490 may be an RF module for exciting the antenna structure 400. Specifically, the feeding radiation element 430 has a first end 431 and a second end 432, which are two open ends away from each other. The first end 431 of the feeding radiation element 430 is adjacent to the coupling radiation element 440. In addition, the feeding point FP2 may be positioned between the first end 431 and the second end 432 of the feeding radiation element 430, and is relatively closer to the second end 432 of the feeding radiation element 430. The feeding radiation element 430 has a first vertical projection on the metal mechanism element 410, and the first vertical projection may be completely inside the slot 420 of the metal mechanism element 410. In some embodiments, the conductive via element 450 penetrates the dielectric substrate 480 and is connected between the first surface E3 and the second surface E4, such that the feeding point FP2 of the feeding radiation element 430 is further coupled through the conductive via element 450 to the signal source 490.

The coupling radiation element 440 may substantially have a widened T-shape. Specifically, the coupling radiation element 440 has a first end 441, a second end 442, and a third end 443. A grounding point GP2 coupled to the ground voltage VSS is positioned at the first end 441 of the coupling radiation element 440. The second end 442 and the third end 443 of the coupling radiation element 440 are two open ends away from each other. In some embodiments, a rectangular notch 445 is formed at a corner of the coupling radiation element 440, and it is adjacent to the second end 442 of the coupling radiation element 440. The coupling radiation element 440 has a second vertical projection on the metal mechanism element 410, and the second vertical projection is at least partially inside the slot 420 of the metal mechanism element 410. In addition, the second vertical projection of the coupling radiation element 440 at least partially overlaps the first vertical projection of the feeding radiation element 430. Thus, a coupling gap can be formed between the second end 442 of the coupling radiation element 440 and the first end 431 of the feeding radiation element 430.

The first parasitic radiation element 460 may substantially have a widened L-shape. Specifically, the first parasitic radiation element 460 has a first end 461 and a second end 462. The first end 461 of the first parasitic radiation element 460 is coupled to the ground voltage VSS. The second end 462 of the first parasitic radiation element 460 is an open end, which extends toward the coupling radiation element 440. The first parasitic radiation element 460 has a third vertical projection on the metal mechanism element 410, and the third vertical projection is at least partially inside the slot 420 of the metal mechanism element 410.

The second parasitic radiation element 470 may substantially have an inverted L-shape. Specifically, the second parasitic radiation element 470 has a first end 471 and a second end 472. The first end 471 of the second parasitic radiation element 470 is an open end, which extends toward the feeding radiation element 430. The second end 472 of the second parasitic radiation element 470 is another open end. A connection point CP coupled to the ground voltage VSS is positioned between the first end 471 and the second end 472 of the second parasitic radiation element 470. The second parasitic radiation element 470 has a fourth vertical projection on the metal mechanism element 410, and the fourth vertical projection is at least partially inside the slot 420 of the metal mechanism element 410.

Figure 5:
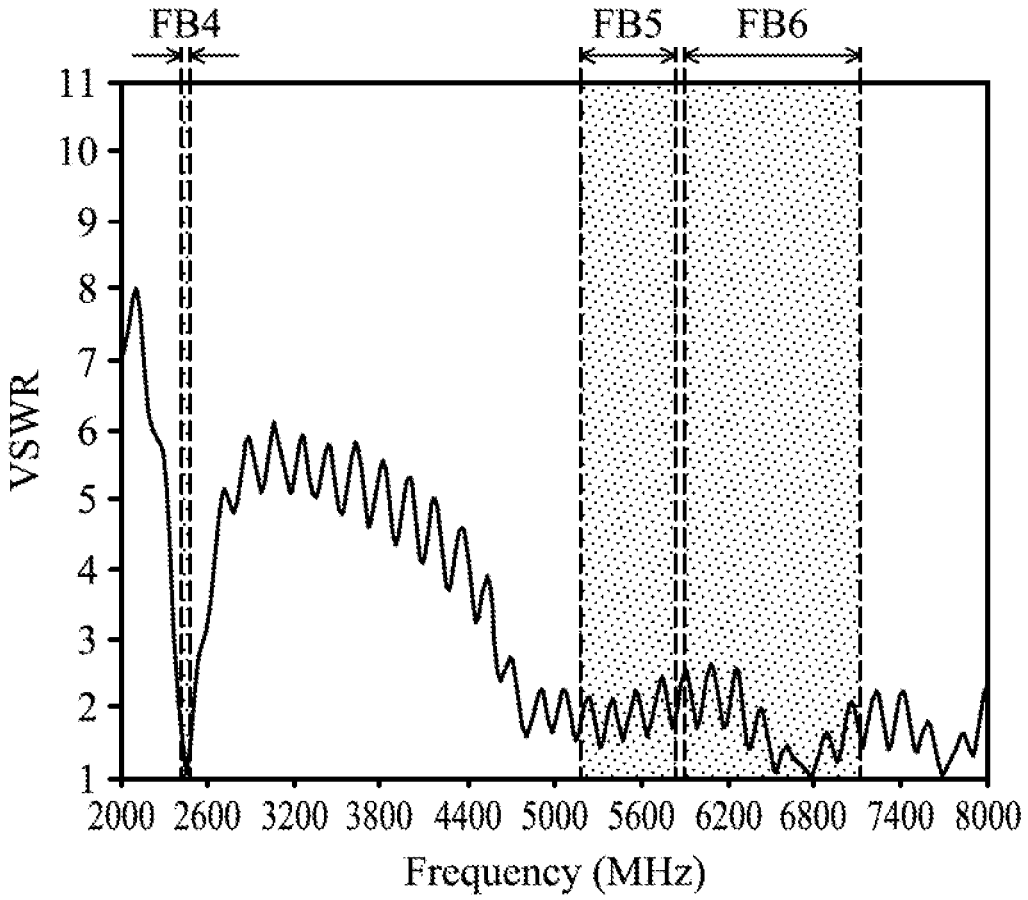
FIG. 5 is a diagram of VSWR of an antenna structure according to an embodiment of the invention.

FIG. 5 is a diagram of VSWR of the antenna structure 400 according to an embodiment of the invention. The horizontal axis represents operation frequency (MHz), and the vertical axis represents the VSWR. According to the measurement of FIG. 5, the antenna structure 400 covers a first frequency band FB4, a second frequency band FB5, and a third frequency band FB6. For example, the first frequency band FB4 may be from 2400 MHz to 2495 MHz, the second frequency band FB5 may be from 5150 MHz to 5835 MHz, and the third frequency band FB6 may be from 5925 MHz to 7125 MHz. Thus, the antenna structure 400 can support at least the wideband operations of the next generation Wi-Fi 6E.

Figure 6:
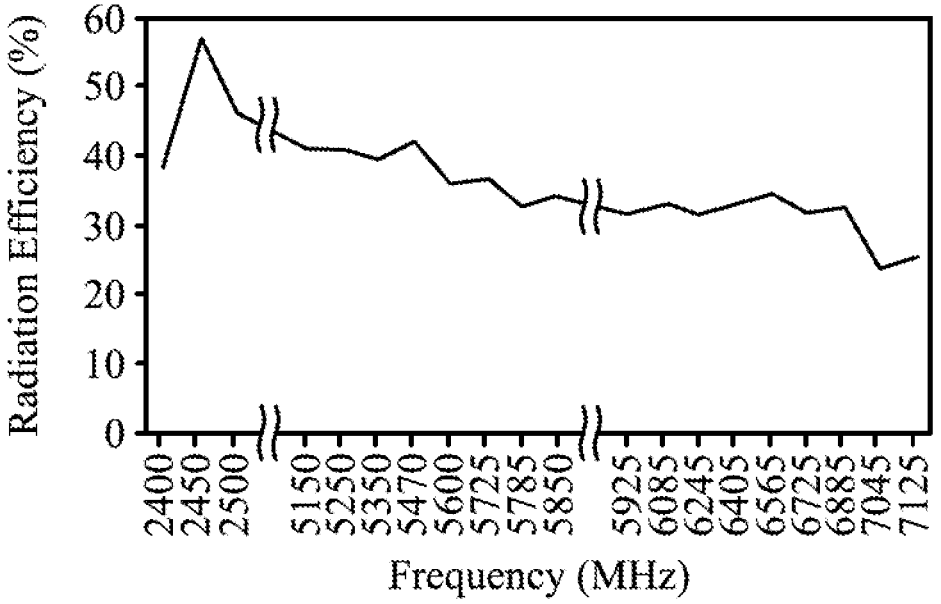
FIG. 6 is a diagram of radiation efficiency of an antenna structure according to an embodiment of the invention.

FIG. 6 is a diagram of radiation efficiency of the antenna structure 400 according to an embodiment of the invention. The horizontal axis represents the operation frequency (MHz), and the vertical axis represents the radiation efficiency. According to the measurement of FIG. 6, the radiation efficiency of the antenna structure 400 reaches 20% or higher within the first frequency band FB4, the second frequency band FB5, and the third frequency band FB6, and it can meet the requirements of practical application of general mobile communication devices.

With respect to the antenna theory, an equivalent capacitor can be formed between the first end 431 of the feeding radiation element 430 and the second end 442 of the coupling radiation element 440, such that the feeding radiation element 430 and the coupling radiation element 440 are almost considered as a loop structure. The slot 420 of the metal mechanism element 410 can be excited by the aforementioned loop structure using a coupling mechanism, so as to completely cover the wideband operations of the first frequency band FB4, the second frequency band FB5, and the third frequency band FB6. According to practical measurements, the incorporation of the first parasitic radiation element 460 and the second parasitic radiation element 470 can fine-tune the impedance matching of the first frequency band FB4, the second frequency band FB5, and the third frequency band FB6. Thus, the antenna structure 400 is applicable to communication devices used for different environments, and its good radiation performance is maintained.

In some embodiments, the sizes of the elements of the antenna structure 400 are as follows. The length L3 of the slot 420 of the metal mechanism element 410 (i.e., the length L3 from the first closed end 421 to the second closed end 422) may be from ¼ to ½ wavelength ($\lambda/4 \sim \lambda/2$) of the first frequency band FB4 of the antenna structure 400. The distance D3 between the feeding point FP2 and the first end 431 of the feeding radiation element 430 may be from ⅛ to ¼ wavelength ($\lambda/8 \sim \lambda/4$) of the second frequency band FB5 of the antenna structure 400. The distance D4 between the feeding point FP2 and the second closed end 422 of the slot 420 may be from ⅓ to ½ times the length L3 of the slot 420. The length L4 of the coupling radiation element 440 (i.e., the length L4 from the first end 441 to the second end 442) may be shorter than or equal to ½ wavelength ($\lambda/2$) of the third frequency band FB6 of the antenna structure 400. The thickness H2 of the dielectric substrate 480 (i.e., the distance between the first surface E3 and the second surface E4) may be from 0.2 mm to 1.6 mm. The overlapping distance DB between the first end 431 of the feeding radiation element 430 and the second end 442 of the coupling radiation element 440 may be longer than or equal to 1 mm. The distance D5 between the second end 462 of the first parasitic radiation element 460 and the third end 443 of the coupling radiation element 440 may be longer than or equal to 3 mm. The distance D6 between the first end 471 of the second parasitic radiation element 470 and the second end 432 of the feeding radiation element 430 may be longer than or equal to 3 mm. The above ranges of element sizes are calculated and obtained according to many experiment results, and they help to optimize the operation bandwidth and impedance matching of the antenna structure 400.

The invention proposes a novel antenna structure for integrating with a metal mechanism element of a mobile device. In comparison to the conventional design, the invention has at least the advantages of small size, wide bandwidth, low manufacturing cost, and adapting to different environments, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-6. The invention may merely include any one or more features of any one or more embodiments of FIGS. 1-6. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a metal mechanism element, having a slot, wherein the slot has a first closed end and a second closed end;

a dielectric substrate, having a first surface and a second surface opposite to each other;

a feeding radiation element, coupled to a signal source, and disposed on the second surface of the dielectric substrate, wherein the feeding radiation element has a first vertical projection on the metal mechanism element; and a coupling radiation element, coupled to a ground voltage, and disposed on the first surface of the dielectric substrate, wherein the coupling radiation element has a second vertical projection on the metal mechanism element;

wherein the second vertical projection of the coupling radiation element at least partially overlaps the first vertical projection of the feeding radiation element.

2. The antenna structure as claimed in claim 1, wherein the antenna structure covers a first frequency band, a second frequency band, and a third frequency band, the first frequency band is from 2400 MHz to 2495 MHz, the second frequency band is from 5150 MHz to 5835 MHz, and the third frequency band is from 5925 MHz to 7125 MHz.

3. The antenna structure as claimed in claim 2, wherein a length of the slot is from ¼ to ½ wavelength of the first frequency band.

4. The antenna structure as claimed in claim 1, wherein the first vertical projection of the feeding radiation element is completely inside the slot.

5. The antenna structure as claimed in claim 1, wherein the feeding radiation element substantially has a straight-line shape.

6. The antenna structure as claimed in claim 2, wherein the feeding radiation element has a first end and a second end, the first end of the feeding radiation element is adjacent to the coupling radiation element, and a feeding point coupled to the signal source is positioned between the first end and the second end of the feeding radiation element.

7. The antenna structure as claimed in claim 6, further comprising:

a conductive via element, penetrating the dielectric substrate, wherein the feeding point of the feeding radiation element is coupled through the conductive via element to the signal source.

8. The antenna structure as claimed in claim 6, wherein a distance between the feeding point and the first end of the feeding radiation element is from ⅛ to ¼ wavelength of the second frequency band.

9. The antenna structure as claimed in claim 6, wherein a distance between the feeding point and the first closed end or the second closed end of the slot is from ⅓ to ½ times of a length of the slot.

10. The antenna structure as claimed in claim 1, wherein the second vertical projection of the coupling radiation element is at least partially inside the slot.

11. The antenna structure as claimed in claim 1, wherein the coupling radiation element substantially has an L-shape or a T-shape.

12. The antenna structure as claimed in claim 1, wherein a notch is formed at a corner of the coupling radiation element.

13. The antenna structure as claimed in claim 1, wherein the coupling radiation element has a first end and a second end, a grounding point coupled to the ground voltage is positioned at the first end of the coupling radiation element, and the second end of the coupling radiation element is an open end.

14. The antenna structure as claimed in claim 2, wherein a length of the coupling radiation element is shorter than or equal to ½ wavelength of the third frequency band.

15. The antenna structure as claimed in claim 1, further comprising:

a first parasitic radiation element, coupled to the ground voltage, and disposed on the first surface of the dielectric substrate.

16. The antenna structure as claimed in claim 15, wherein the first parasitic radiation element substantially has a widened L-shape.

17. The antenna structure as claimed in claim 15, wherein a distance between the first parasitic radiation element and the coupling radiation element is longer than or equal to 3 mm.

18. The antenna structure as claimed in claim 1, further comprising:

a second parasitic radiation element, coupled to the ground voltage, and disposed on the first surface of the dielectric substrate.

19. The antenna structure as claimed in claim 18, wherein the second parasitic radiation element substantially has an inverted L-shape.

20. The antenna structure as claimed in claim 18, wherein a distance between the second parasitic radiation element and the feeding radiation element is longer than or equal to 3 mm.

* * * * *